United States Patent [19]

Kramlinger

[11] 4,263,852

[45] Apr. 28, 1981

[54] SIDE SHIFTABLE RAILWAY CAR

[75] Inventor: Philip J. Kramlinger, Roseville, Minn.

[73] Assignee: The Maxson Corporation, St. Paul, Minn.

[21] Appl. No.: 8,271

[22] Filed: Feb. 1, 1979

[51] Int. Cl.[3] ..... B61C 9/00

[52] U.S. Cl. ..... 105/199 C; 105/157 R; 202/262; 308/137

[58] Field of Search ..... 105/199 C, 157, 182, 105/201; 202/262, 263, 95, 227, 253; 308/137

[56] References Cited

U.S. PATENT DOCUMENTS

| | | | |
|---|---|---|---|
| 1,224,684 | 5/1917 | Sullivan | 105/201 |
| 3,501,383 | 3/1970 | Wethly | 202/262 |

*Primary Examiner*—Richard A. Bertsch

*Attorney, Agent, or Firm*—Neil B. Schulte

[57] ABSTRACT

A side shiftable railway car in which the bolsters resting on the wheeled trucks engage a movable center plate on the underside of the car. The center plate may be slid sideways along retaining flanges welded to the underside of the car and locked in place by heavy keeper pins adapted to be inserted and extracted manually with levers.

7 Claims, 4 Drawing Figures

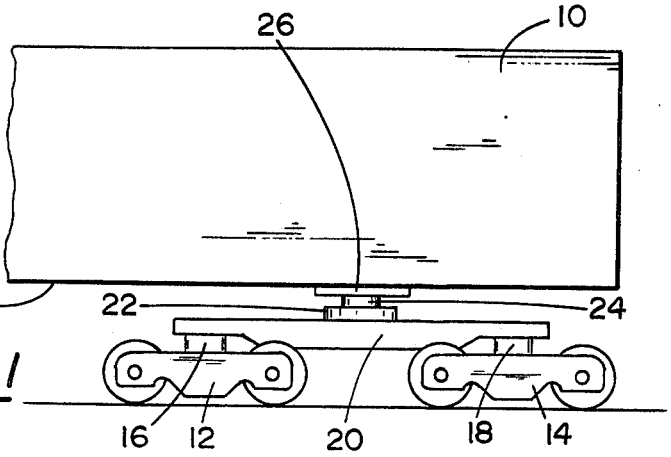
FIG. 1
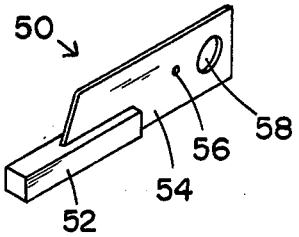
FIG. 4
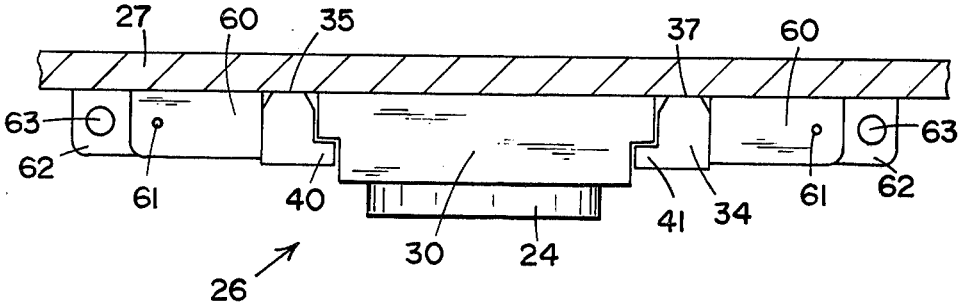
FIG. 2
FIG. 3
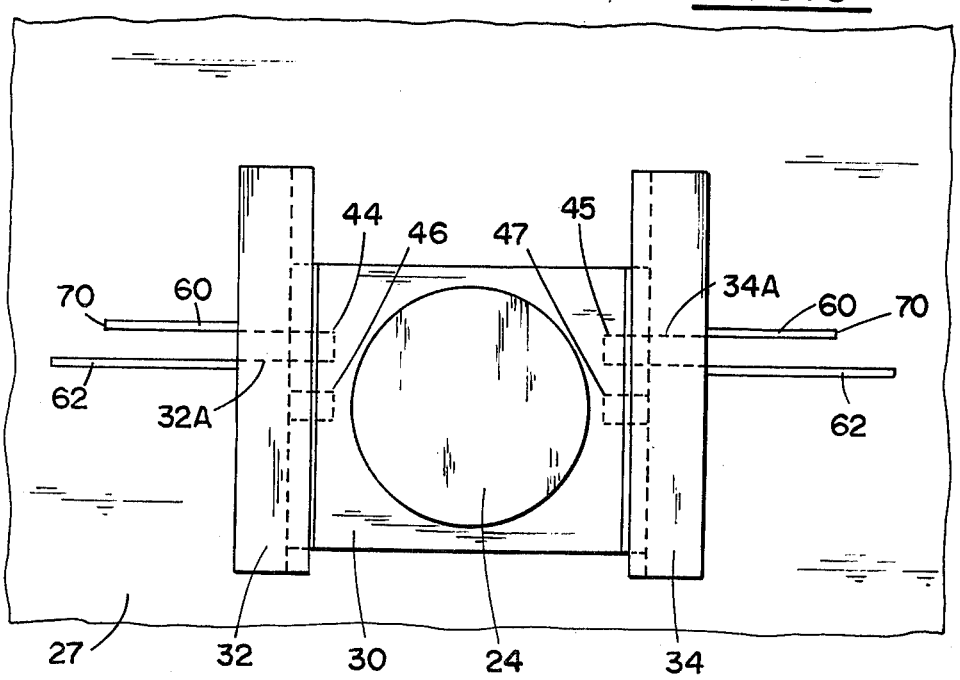

SIDE SHIFTABLE RAILWAY CAR

BACKGROUND OF THE INVENTION

Occasionally it is necessary to have a railway car that can be shifted sideways for clearance purposes. An example of this are the coke quenching cars used in coke manufacturing plants. A sideways shift of six inches may be necessary to properly align the car for loading and unloading coke. Cars that are displaced this amount may not be transported across country legally since they exceed standards set down by regulation. Accordingly, it is desirable to have a car which may be positioned symmetrically on its trucks for transportation to the working site, and then shifted sideways with a minimum of expense and effort.

In the prior art it is known to provide cars which can be shifted sideways relative to their wheels and the tracks. However, these prior art devices necessitate the use of extremely expensive and large cranes to lift up the car and shift it sideways while the connection points between the car and the trucks are altered. Generally this operation cannot take place at the location where the car is to be used and thus the car must be moved to an intermediate area where the side shifting operation can be completed with the assistance of cranes. My invention provides an improved design which permits the desired side shifting to be done at the working location with a minimum of time and expense. An expensive crane is no longer needed and the number of men involved for the operation is reduced.

BRIEF SUMMARY OF THE INVENTION

Briefly, the present invention contemplates a center plate on the underside of the car which is movable in grooved tracks or flanges by the desired side shift distance and locked in place with suitable keeper pins. Throughout the operation the car remains on the wheeled trucks and does not have to be lifted by a crane. A worker simply uses a lever to extract the keeper pins, moves the car sideways by means of a hand-operated hydraulic jack, and then reinserts the pins again, with the lever, locking them in place with cotter pins. It may therefore be seen that it is an object of my invention to provide an improved side shiftable car which can be quickly moved with a minimum of time, expense, and labor. Further objects and advantages will become apparent from the following detailed description and drawings.

BRIEF DESCRIPTION OF THE DRAWINGS

FIG. 1 is an elevational view of one end of a railway car, schematically drawn to show the major elements in the present invention.

FIG. 2 is a greatly enlarged view of the flange retained movable center plate as shown from the same direction as FIG. 1 with the car body cut away.

FIG. 3 is a plan view of the underside of the car as viewed from the bottom of FIG. 2.

FIG. 4 is a perspective view of one of the four keeper pins utilized to lock the center plate in position.

DESCRIPTION OF THE PREFERRED EMBODIMENT

In FIG. 1 one half of a railway car 10 is shown, the other half being cut away for ease of description. It should be understood that a side shift mechanism of the type disclosed herein would be utilized at each end of the car in connection with each set of wheels. In FIG. 1 car 10 rides on a pair of trucks 12 and 14 which have bolsters 16 and 18 mounted transversely thereon. A span bolster 20 is carried by the cross bolsters 16 and 18 in a manner well known to those skilled in the railroad arts. Span bolster 20 has a conventional center bowl 22 which accepts a cylindrical center plate 24 extending from a center plate assembly 26. Center plate 24 engages center bowl 22 in a manner well known to those skilled in the arts and comprises conventional railway technology.

Center plate assembly 26 is shown greatly enlarged in FIG. 2. Center plate assembly 26 is mounted to the underside 27 of car 10. Assembly 26 comprises a sliding plate 30 which is T-shaped so as to slide between the underside of the car 27 and a pair of flanges or guides 32 and 34. Flanged guides 32 and 34 are welded to the car 10 at 35 and 37 along their entire length. Flanged guides 32 and 34 include projecting flanges 40 and 41 which retain sliding plate 30. Although not shown in the drawings, flanged guides 32 and 34 may be suitably reinforced by welding gussets between them and the bottom of the car at several suitable locations.

In the plan view of FIG. 3 it may be seen that sliding plate 30 includes four notches 44, 45, 46, and 47 in the sides to accept the keeper pins. One of these keeper pins is shown in perspective in FIG. 4. The keeper pin 50 includes the actual locking pin 52 and a handle portion 54. Handle 54 includes a cotter pin hole 56 and a prying hole 58. Returning to FIG. 3, it may be seen that flanged guide 32 has a generally rectangular hole 32A therethrough. Similarly, flanged guide 34 has a hole 34A. In FIG. 3, sliding plate 30 is positioned so that notches 44 and 45 are aligned with holes 32A and 34A. To lock sliding plate 30 in position it is necessary only to slide keeper pin 50 through holes 32A and 34A and into notches 44 and 45 in the sliding plate 30. This will lock sliding plate 30 in the sideways shifted position shown in FIG. 3. Welded alongside the paths of the keeper pins 50 are a pair of short guide plates 60 with cotter pin holes 61 and a pair of longer guide plates 62 with prying holes 63. Guide plates 62 also have cotter pin holes in them but they are not visible in FIG. 2. When the keeper pins 50 are inserted through the holes in the flanged guides into the notches in sliding plate 30 they are held therein by cotter pins inserted through holes 61 and 56.

Shifting the car sideways is quite a simple operation. The above mentioned cotter pins are removed and the keeper pins 50 extracted with the use of a pry bar inserted through hole 58 and bearing against hole 63 or else against the end of short guide plates 60 at the points indicated with the numerals 70. Car 10 is then slid sideways by inserting a hand operated jack or other suitable device between the frame of car 10 and span bolster 20. When notches 46 and 47 come into alignment with holes 32A and 34A, the keeper pins 50 are reinserted again with the use of a pry bar as outlined earlier and the cotter pins reinserted. It is not necessary to lift the car with a crane or move the car to a special location for this shifting operation. It is quite easily accomplished with only two men using simple hand tools. Of course, variations may be made to the structure shown without departing from the spirit and scope of the invention as, for example, by altering slightly the design of the flanged guideways or the center plate assembly. Clearly one could use more than four notches in the sliding plate or space them at different positions depending upon the intended useage of the car. Additional side bearings between the car 10 and span bolster 20 are also possible and well known to those skilled in the art. Because of these possible alterations in design it is my intention to be limited only to the following appended claims.

I claim:

1. A side shiftable railway car comprising in combination:

a main car frame member;

A plurality of wheeled trucks with bolster member means connected thereto, said bolster member means having a suitable center bowl;

a center plate assembly for connecting each of said trucks to said main frame member, said assembly comprising guide means mounted transversely to said main car frame on the underside of said frame, and further comprising a sliding plate movable transversely to said main frame in said guide means, said assembly also including locking means on said guide means to fix the sliding plate in selected transverse positions in said guide means, said sliding plate having a center plate affixed thereto, said center plate adapted to engage said center bowl in said bolster member means.

2. The car of claim 1 in which said guide means comprise a pair of flanged guides mounted to the underside of the main frame with the flanges extending toward each other so as to retain said sliding plate between the flanges and the underside of the main frame.

3. The car of claim 1 in which said sliding plate includes notches in selected locations in the edges of the sliding plate so as to accept said locking means therein.

4. The car of claim 1 in which said locking means comprise keeper pins slidable in holes in said guide means to engage and fix said movable sliding plate.

5. The car of claim 4 including keeper pin guide plates positioned adjacent the holes in the guide means to align the keeper pins with said holes, said guide plates adapted to provide prying surfaces for keeper pin moving levers.

6. The car of claim 5 in which said sliding plate includes notches in selected locations in the edges of the sliding plate so as to accept said locking means therein.

7. The car of claim 6 in which said guide means comprise a pair of flanged guides mounted to the underside of the main frame with the flanges extending toward each other so as to retain said sliding plate between the flanges and the underside of the main frame.

* * * * *